US011774875B2

(12) United States Patent
Endo et al.

(10) Patent No.: US 11,774,875 B2
(45) Date of Patent: Oct. 3, 2023

(54) DEVELOPMENT ROLL FOR ELECTROPHOTOGRAPHIC APPARATUSES

(71) Applicant: Sumitomo Riko Company Limited, Aichi (JP)

(72) Inventors: Satoshi Endo, Aichi (JP); Kengo Fujii, Aichi (JP); Kentaro Imai, Aichi (JP); Satoshi Tatsumi, Aichi (JP)

(73) Assignee: Sumitomo Riko Company Limited, Aichi (JP)

( * ) Notice: Subject to any disclaimer, the term of this patent is extended or adjusted under 35 U.S.C. 154(b) by 19 days.

(21) Appl. No.: 17/737,023

(22) Filed: May 5, 2022

(65) Prior Publication Data

US 2022/0260939 A1 Aug. 18, 2022

Related U.S. Application Data

(63) Continuation of application No. PCT/JP2020/043349, filed on Nov. 20, 2020.

(30) Foreign Application Priority Data

Nov. 29, 2019 (JP) ..... 2019-216100

(51) Int. Cl.
*G03G 15/08* (2006.01)

(52) U.S. Cl.
CPC ..... *G03G 15/0808* (2013.01); *G03G 15/08* (2013.01); *G03G 15/0818* (2013.01)

(58) Field of Classification Search
CPC ..... G03G 15/0806; G03G 15/0808; G03G 15/0818
See application file for complete search history.

(56) References Cited

U.S. PATENT DOCUMENTS

| | | | | |
|---|---|---|---|---|
| 8,357,480 | B2 | 1/2013 | Kamoto | |
| 9,014,600 | B2 | 4/2015 | Takeuchi et al. | |
| 2013/0084428 | A1* | 4/2013 | Hayashi ..... | G03G 15/0818 428/141 |

(Continued)

FOREIGN PATENT DOCUMENTS

| | | |
|---|---|---|
| JP | H10293453 | 11/1998 |
| JP | 2001194892 | 7/2001 |
| JP | 2009216838 | 9/2009 |

(Continued)

OTHER PUBLICATIONS

"International Search Report (Form PCT/ISA/210) of PCT/JP2020/043349," dated Jan. 26, 2021, with English translation thereof, pp. 1-5.

(Continued)

*Primary Examiner* — Carla J Therrien
(74) *Attorney, Agent, or Firm* — JCIPRNET

(57) ABSTRACT

The disclosure provides a development roll for electrophotographic apparatuses. The development roll for electrophotographic apparatuses includes: a shaft; an elastic layer formed on an outer circumferential surface of the shaft; a surface layer formed on an outer circumferential surface of the elastic layer; and an end protection layer formed on an outer circumferential surface of the surface layer at both ends in an axial direction. The end protection layer contains a binder polymer and a surface modification agent that has a cyano group.

1 Claim, 2 Drawing Sheets

(56) References Cited

U.S. PATENT DOCUMENTS

| | | | | |
|---|---|---|---|---|
| 2013/0272755 | A1* | 10/2013 | Takeuchi | C09D 175/06 399/286 |
| 2014/0199098 | A1* | 7/2014 | Abe | G03G 15/0808 399/286 |

FOREIGN PATENT DOCUMENTS

| | | |
|---|---|---|
| JP | 2013073130 | 4/2013 |
| JP | 2018059993 | 4/2018 |
| WO | 2012098590 | 7/2012 |

OTHER PUBLICATIONS

"Office Action of China Counterpart Application", dated Mar. 24, 2023, with English translation thereof, p. 1-p. 16.

* cited by examiner

DEVELOPMENT ROLL FOR ELECTROPHOTOGRAPHIC APPARATUSES

CROSS-REFERENCE TO RELATED APPLICATION

This application is a continuation of PCT International Application No. PCT/JP2020/043349, filed on Nov. 20, 2020, which claims priority under 35 U.S.C § 119(a) to Japanese Patent Application No. 2019-216100, filed on Nov. 29, 2019. Each of the above application is hereby expressly incorporated by reference, in its entirety, into the present application.

BACKGROUND

Technical Field

The disclosure relates to a development roll for electrophotographic apparatuses that is suitably used in an electrophotographic apparatus using an electrophotographic method, such as a copying machine, a printer, or a facsimile.

Related Art

In electrophotographic apparatuses, conductive rolls such as a development roll are required to maintain a stable image for a lifespan. In development rolls, toner leakage due to scraping of roll ends which are non-image-forming areas causes a problem in maintaining a stable image for a lifespan. In order to minimize this defect, for example, in Patent Literature 1, it is proposed to provide an end protection layer containing a fluorine-containing resin at a roll end to minimize scraping of the roll end due to wear.

Patent Literature 1: Japanese Patent Laid-Open No. 2018-59993

However, simply providing an end protection layer containing a fluorine-containing resin at the roll end as in Patent Literature 1 does not sufficiently minimize toner leakage in which toner leaks from the roll end.

SUMMARY

A development roll for electrophotographic apparatuses according to the disclosure includes a shaft, an elastic layer formed on an outer circumferential surface of the shaft, a surface layer formed on an outer circumferential surface of the elastic layer, and an end protection layer formed on an outer circumferential surface of the surface layer at both ends in an axial direction. The end protection layer contains a binder polymer and a surface modification agent having a cyano group. The binder polymer is a polyurethane. The surface modification agent having a cyano group is a fluorine-based surface modification agent and is contained in an amount in a range of 0.1 to 20 parts by mass with respect to 100 parts by mass of the binder polymer.

DESCRIPTION OF EMBODIMENTS

Figure 1:
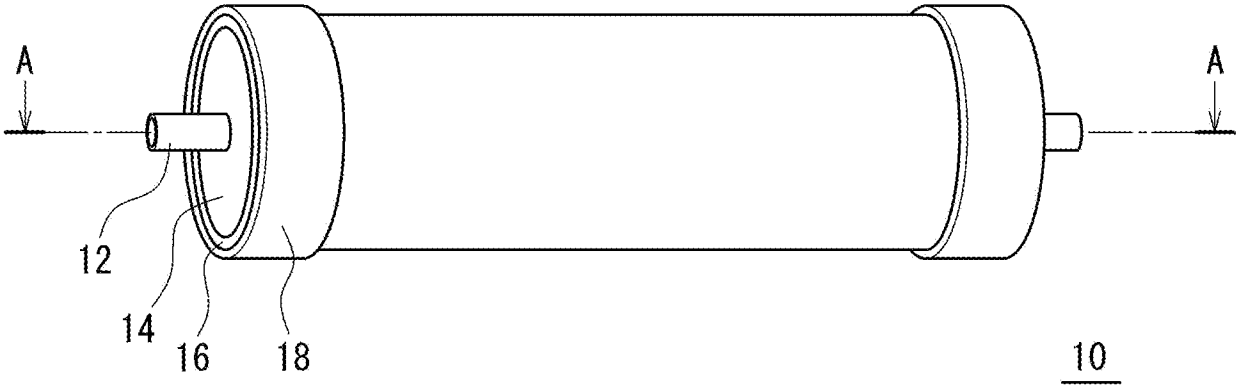
FIG. 1 is an appearance schematic view of a development roll for electrophotographic apparatuses according to one embodiment of the disclosure.

The disclosure is provides a development roll for electrophotographic apparatuses, in which toner leakage from a roll end is minimized.

As a result of extensive studies by the inventors, it has been found that toner leakage from the roll end is caused by a decrease in toner chargeability by rubbing the toner against a development roll (toner deterioration), which makes it difficult for the toner to be supported on the development roll, in addition to scraping of the roll end as described above. Therefore, the inventors found that, by increasing the amount of remaining charge of the roll end, a decrease in toner chargeability due to toner deterioration is compensated for to improve the toner carrying capacity on the side of the development roll, and toner leakage from the roll end is electrically minimized.

That is, a development roll for electrophotographic apparatuses according to the disclosure includes a shaft, an elastic layer formed on an outer circumferential surface of the shaft, a surface layer formed on an outer circumferential surface of the elastic layer, and an end protection layer formed on an outer circumferential surface of the surface layer at both ends in an axial direction, wherein the end protection layer contains a binder polymer and a surface modification agent having a cyano group.

The surface modification agent having a cyano group is preferably a fluorine-based surface modification agent. The content of the surface modification agent having a cyano group is preferably in a range of 0.1 to 20 parts by mass with respect to 100 parts by mass of the binder polymer. The binder polymer is preferably a polyurethane. The end protection layer preferably further contains a thermally conductive material. The thermally conductive material is preferably alumina particles.

According to the development roll for electrophotographic apparatuses according to the disclosure, since the end protection layer contains a binder polymer and a surface modification agent having a cyano group, the amount of remaining charge of the roll end increases, and toner leakage from the roll end is minimized.

When the surface modification agent having a cyano group is a fluorine-based surface modification agent, the amount of remaining charge at the roll end is particularly large, and an effect of minimizing toner leakage from the roll end is improved. In addition, when the content of the surface modification agent having a cyano group is in a range of 0.1 to 20 parts by mass with respect to 100 parts by mass of the binder polymer, the balance between the effect of minimizing toner leakage from the roll end and the effect of minimizing wear of the end protection layer is excellent. Here, when the binder polymer is a polyurethane, the wear resistance becomes better. Here, when the end protection layer further contains a thermally conductive material, heat dissipation of the end protection layer is improved, toner deterioration due to heat is minimized, and an effect of minimizing toner leakage from the roll end due to a decrease in toner chargeability is improved. Here, when the thermally conductive material is alumina particles, the thermal conduction efficiency is excellent, and heat dissipation of the end protection layer is excellent.

Figure 2:
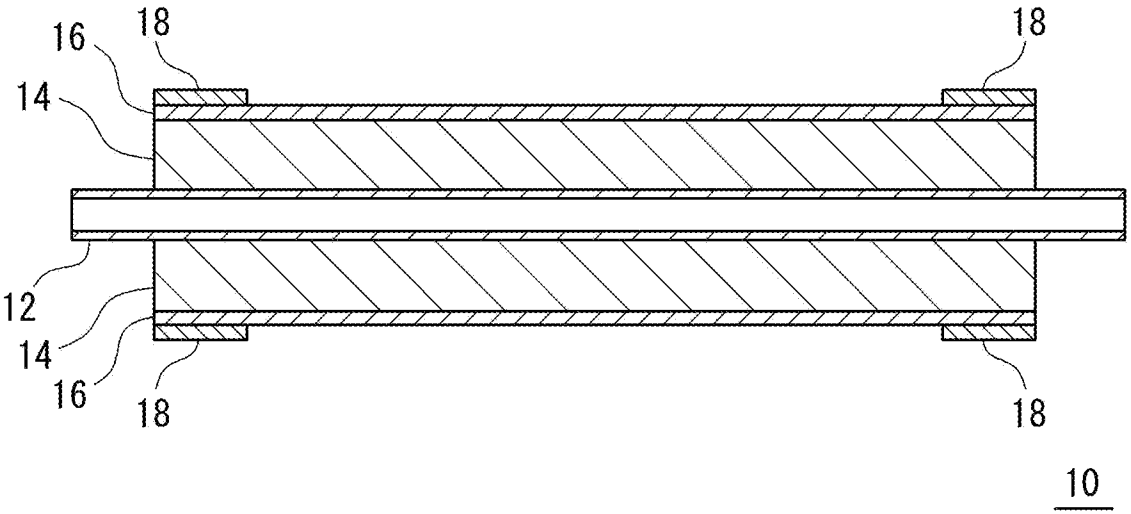
FIG. 2 is a cross-sectional view of the development roll for electrophotographic apparatuses shown in FIG. 1 along the line A-A.

A development roll for electrophotographic apparatuses according to the disclosure (hereinafter, simply referred to as a development roll) will be described in detail. FIG. 1 is an appearance schematic view of a development roll for electrophotographic apparatuses according to one embodiment of the disclosure. FIG. 2 is a cross-sectional view of the development roll for electrophotographic apparatuses shown in FIG. 1 along the line A-A.

A development roll 10 includes a shaft 12, an elastic layer 14 formed on the outer circumferential surface of the shaft 12, a surface layer 16 formed on the outer circumferential surface of the elastic layer 14, and an end protection layer 18 formed at both ends on the outer circumferential surface of the surface layer 16 in the axial direction. The elastic layer 14 is a layer that is a base (a base layer) of the development roll 10. In the development roll 10, the center part in the axial direction is an image-forming area, and both ends in the axial direction are non-image-forming areas. The surface layer 16 is covered with the end protection layer 18 in the non-image-forming areas at both ends in the axial direction. The surface layer 16 is not covered with the end protection layer 18 in the image-forming area in the center part in the axial direction. The surface layer 16 appears on the surface in the image-forming area in the center part in the axial direction. In addition, although not particularly shown, an intermediate layer such as a resistance adjusting layer may be formed between the elastic layer 14 and the surface layer 16 as necessary.

The shaft 12 is not particularly limited as long as it has conductivity. Specific examples thereof include a solid body made of a metal such as iron, stainless steel, or aluminum and a metal core formed of a hollow body. As necessary, an adhesive, a primer and the like may be applied to the surface of the shaft 12. That is, the elastic layer 14 may be adhered to the shaft 12 with an adhesive layer (primer layer) therebetween. As necessary, the adhesive, the primer, and the like may be made conductive.

The elastic layer 14 contains a crosslinked rubber. The elastic layer 14 is formed of a conductive rubber composition containing an uncrosslinked rubber. The crosslinked rubber is obtained by cross-linking an uncrosslinked rubber. The uncrosslinked rubber may be a polar rubber or a non-polar rubber.

The polar rubber is a rubber having a polar group, and examples of polar groups include a chloro group, a nitrile group, a carboxyl group, and an epoxy group. Specific examples of polar rubbers include hydrin rubber, nitrile rubber (NBR), urethane rubber (U), acrylic rubber (a copolymer of acrylic ester and 2-chloroethyl vinyl ether, ACM), chloroprene rubber (CR), and epoxidized natural rubber (ENR). Among polar rubbers, hydrin rubber or nitrile rubber (NBR) is more preferable because the volume resistivity is particularly easily reduced.

Examples of hydrin rubbers include an epichlorohydrin homopolymer (CO), an epichlorohydrin-ethylene oxide binary copolymer (ECO), an epichlorohydrin-allyl glycidyl ether binary copolymer (GCO), and an epichlorohydrin-ethylene oxide-allyl glycidyl ether terpolymer (GECO).

Examples of urethane rubbers include a polyether type urethane rubber having an ether bond in the molecule. The polyether type urethane rubber can be produced by a reaction between a polyether having a hydroxyl group at both ends and a diisocyanate. The polyether is not particularly limited, and examples thereof include polyethylene glycol and polypropylene glycol. The diisocyanate is not particularly limited, and examples thereof include tolylene diisocyanate and diphenylmethane diisocyanate.

Examples of non-polar rubbers include silicone rubber (Q), isoprene rubber (IR), natural rubber (NR), styrene butadiene rubber (SBR), and butadiene rubber (BR). Among non-polar rubbers, a silicone rubber is more preferable because it has low hardness and is less likely to be fatigued (has excellent elastic recovery).

Examples of crosslinking agents include a sulfur crosslinking agent, a peroxide crosslinking agent, and a dechlorination crosslinking agent. These crosslinking agents may be used alone or two or more thereof may be used in combination.

Examples of sulfur crosslinking agents include conventionally known sulfur crosslinking agents such as powdered sulfur, precipitated sulfur, colloidal sulfur, surface-treated sulfur, insoluble sulfur, sulfur chloride, a thiuram-based vulcanization accelerator, and a high-molecular-weight polysulfide.

Examples of peroxide crosslinking agents include conventionally known peroxide crosslinking agents such as peroxyketal, dialkyl peroxides, peroxyester, ketone peroxide, peroxydicarbonate, diacyl peroxide, and hydroperoxide.

Examples of dechlorination crosslinking agents include a dithiocarbonate compound. More specifically, quinoxaline-2,3-dithiocarbonate, 6-methylquinoxaline-2,3-dithiocarbonate, 6-isopropylquinoxaline-2,3-dithiocarbonate, 5,8-dimethylquinoxaline-2,3-dithiocarbonate, and the like may be exemplified.

The formulation amount of the crosslinking agent is preferably in a range of 0.1 to 2 parts by mass, more preferably in a range of 0.3 to 1.8 parts by mass, and still more preferably in a range of 0.5 to 1.5 parts by mass with respect to 100 parts by mass of the uncrosslinked rubber in order to prevent bleeding.

When a dechlorination crosslinking agent is used as the crosslinking agent, a dechlorination crosslinking accelerator may be used in combination. Examples of dechlorination crosslinking accelerators include 1,8-diazabicyclo(5,4,0)undecene-7 (hereinafter abbreviated as DBU) and its weak acid salts. The dechlorination crosslinking accelerator may be used in the form of DBU but is preferably used in the form of its weak acid salts in consideration of handling. Examples of weak acid salts for DBU include its carbonate, stearate, 2-ethylhexylate, benzoate, salicylate, 3-hydroxy-2-naphthoate, phenolic resin salt, 2-mercaptobenzothiazole salt, and 2-mercaptobenzimidazole salt.

The content of the dechlorination crosslinking accelerator is preferably in a range of 0.1 to 2 parts by mass, more preferably in a range of 0.3 to 1.8 parts by mass, and still more preferably in a range of 0.5 to 1.5 parts by mass with respect to 100 parts by mass of the uncrosslinked rubber in order to prevent bleeding.

In order to impart conductivity, a conducting agent can be added to the elastic layer 14. Examples of conducting agents include an electron-conducting agent and an ion-conducting agent. Examples of electron-conducting agents include carbon black, graphite, and conductive metal oxides. Examples of conductive metal oxides include conductive titanium oxides, conductive zinc oxides, and conductive tin oxides. Examples of ion-conducting agents include quaternary ammonium salts, quaternary phosphonium salts, borates, and surfactants. In addition, as necessary, various additives may be appropriately added to the elastic layer 14. Examples of additives include a lubricant, a vulcanization accelerator, an anti-aging agent, an optical stabilizer, a viscosity adjusting agent, a processing aid, a flame retardant, a plasticizer, a foaming agent, a filler, a dispersant, an anti-foaming agent, a pigment, and a mold release agent.

The elastic layer 14 can be adjusted to have a predetermined volume resistivity depending on the type of the crosslinked rubber, the formulation amount of the ion-conducting agent, formulating with an electron-conducting agent, and the like. The volume resistivity of the elastic layer 14 may be appropriately set in a range of $10^2$ to $10^{10}$ Ω·cm, $10^3$ to $10^9$ Ω·cm, $10^4$ to $10^8$ Ω·cm depending on applications and the like. The volume resistivity can be measured according to JIS K 6911.

The thickness of the elastic layer 14 is not particularly limited, and may be appropriately set in a range of 0.1 to 10 mm depending on applications and the like.

The surface layer 16 contains at least a binder polymer. Examples of binder polymers include a urethane resin, a polyamide resin, an acrylic resin, an acrylic silicone resin, a butyral resin (PVB), an alkyd resin, a polyester resin, a fluorine rubber, a fluorine resin, a mixture of a fluorine rubber and a fluorine resin, a silicone resin, a silicone-grafted acrylic polymer, an acrylic-grafted silicone polymer, a nitrile rubber, and a urethane rubber. Among these, a urethane resin is preferable in consideration of wear resistance, flexibility, conductivity controllability and the like.

In order to impart conductivity, a conducting agent can be added to the surface layer 16. Examples of conducting agents include an electron-conducting agent and an ion-conducting agent. Examples of electron-conducting agents include carbon black, graphite, and conductive metal oxides. Examples of conductive metal oxides include conductive titanium oxides, conductive zinc oxides, and conductive tin oxides. Examples of ion-conducting agents include quaternary ammonium salts, quaternary phosphonium salts, borates, and surfactants. In addition, as necessary, various additives may be appropriately added to the surface layer 16. Examples of additives include a plasticizer, a leveling agent, filler, a vulcanization accelerator, a processing aid, and a mold release agent.

The volume resistivity of the surface layer 16 may be set in a semi-conductive area in consideration of chargeability and the like. Specifically, for example, it may be set in a range of $1.0\times10^7$ to $1.0\times10^{12}$ Ω·cm. The volume resistivity can be measured according to JIS K 6911.

The thickness of the surface layer 16 is not particularly limited, and may be set in a range of 0.1 to 20 μm. The thickness of the surface layer 16 can be measured by observing the cross section using a laser microscope (for example, "VK-9510" commercially available from Keyence Corporation). For example, the thickness can be represented by an average of distances from the surface of the elastic layer 14 to the surface of the surface layer 16 measured at five arbitrary positions.

The end protection layer 18 has, as a basic function, a function of minimizing toner leakage from the end due to wear of the roll end. Thus, the end protection layer 18 contains a binder polymer and a surface modification agent having a cyano group. When the end protection layer 18 contains the surface modification agent having a cyano group, the amount of remaining charge at the roll end increases. Therefore, the chargeability of the toner deteriorated by rubbing against the development roll 10 decreases, which makes it difficult for the toner to be supported on the development roll 10, and regarding this problem, the toner carrying capacity on the side of the development roll 10 can be improved, toner leakage from the roll end can be electrically minimized, and the image quality can be maintained until the end of the lifespan.

Examples of surface modification agents having a cyano group include a fluorine-based surface modification agent, a silicone-based surface modification agent, an acrylic surface modification agent, and an acrylic silicone-based surface modification agent. The surface modification agents having a cyano group may be used alone or two or more thereof may be used in combination. Among these, a fluorine-based surface modification agent is more preferable. When the surface modification agent having a cyano group is a fluorine-based surface modification agent, the amount of remaining charge at the roll end is particularly large, and an effect of minimizing toner leakage from the roll end is improved. In addition, the fluorine-based surface modification agent tends to be unevenly distributed in the vicinity of the surface, and the above effect is strong even with a small amount.

Examples of fluorine-based surface modification agents include a fluorine-based surfactant. The fluorine-based surfactant is a fluorine-containing surfactant. Examples of fluorine-based surface modification agents include Megaface series (commercially available from DIC). Examples of silicone-based surface modification agents include a silicone oil. Examples of acrylic surface modification agents include an acrylic polymer and a silicone acrylic polymer. The acrylic polymer is an acrylic homopolymer or an acrylic copolymer composed of one or more of an acrylic acid ester or a methacrylic acid ester. The silicone acrylic polymer is a silicone-modified acrylic polymer. Examples of acrylic silicone-based surface modification agents include an acrylic-modified silicone polymer.

The content of the surface modification agent having a cyano group in the end protection layer 18 is preferably in a range of 0.1 to 20 parts by mass with respect to 100 parts by mass of the binder polymer of the end protection layer 18. When the content of the surface modification agent having a cyano group is 0.1 parts by mass or more with respect to 100 parts by mass of the binder polymer, an effect of minimizing toner leakage from the roll end is excellent. In addition, in this regard, the content of the surface modification agent having a cyano group is more preferably 0.5 parts by mass or more, and still more preferably 1.0 part by mass or more with respect to 100 parts by mass of the binder polymer. Here, when the content of the surface modification agent having a cyano group is 20 parts by mass or less with respect to 100 parts by mass of the binder polymer, since the amount of the binder polymer is secured, an effect of minimizing wear of the end protection layer is excellent. In addition, in this regard, the content of the surface modification agent having a cyano group is more preferably 15 parts by mass or less, and still more preferably 10 parts by mass or less with respect to 100 parts by mass of the binder polymer.

The binder polymer of the end protection layer 18 is not particularly limited, and examples thereof include a urethane resin, a polyamide resin, an acrylic resin, an acrylic silicone resin, a butyral resin (PVB), an alkyd resin, a polyester resin, a fluorine rubber, a fluorine resin, a mixture of a fluorine rubber and a fluorine resin, a silicone resin, a silicone-grafted acrylic polymer, an acrylic-grafted silicone polymer, a nitrile rubber, and a urethane rubber. The binder polymers of the end protection layer 18 may be used alone or two or more thereof may be used in combination. Among these, a polyurethane such as a urethane resin and a urethane rubber is more preferable in consideration of excellent wear resistance and the like.

Examples of polyurethanes include an ether polyurethane having an ether bond in the molecule and an ester polyurethane having an ester bond in the molecule. The ether polyurethane contains a polyether polyol as a polyol component. Examples of polyethers include polyethylene glycol (PEG) and polypropylene glycol (PPG). The ester polyurethane contains a polyester polyol as a polyol component. Examples of polyester polyols include polyethylene adipate, polybutylene adipate, polyhexylene adipate, ethylene adipate and butylene adipate, and a copolymer with carbonate diol. The isocyanate component of polyurethane is not particularly limited, and examples thereof include tolylene diisocyanate (TDI) and diphenylmethane diisocyanate (MDI). Among polyurethanes, an ester polyurethane is more preferable in consideration of wear resistance and the like.

The end protection layer 18 may further contain a thermally conductive material. When the thermally conductive material is contained, heat dissipation of the end protection layer 18 is improved, toner deterioration due to friction heat or the like is minimized, and an effect of minimizing toner leakage from the roll end due to a decrease in toner chargeability is improved.

The thermal conductivity of the thermally conductive material is preferably 1 W/(m·K) or more in consideration of thermal conductivity. Examples of thermally conductive materials include an inorganic filler. Examples of inorganic fillers having excellent thermal conductivity include metal particles such as aluminum, gold, and copper, carbon material such as graphite, and carbon fibers, and ceramic particles such as aluminum oxide (alumina), aluminum hydroxide, magnesium hydroxide, magnesium oxide, talc, boehmite, boron nitride, aluminum nitride, silicon nitride, and silicon carbide. Among these, alumina particles are preferable in consideration of excellent thermal conduction efficiency, excellent heat dissipation of the end protection layer 18 and the like.

In consideration of an excellent heat dissipation improving effect of the end protection layer 18 and the like, the content of the thermally conductive material in the end protection layer 18 is preferably 10 parts by mass or more, more preferably 20 parts by mass or more, and still more preferably 30 parts by mass or more with respect to 100 parts by mass of the binder polymer. On the other hand, in consideration of wear resistance, the resin strength of the end protection layer, and the like, the content of the thermally conductive material in the end protection layer 18 is preferably 100 parts by mass or less, more preferably 90 parts by mass or less, and still more preferably 80 parts by mass or less with respect to 100 parts by mass of the binder polymer.

As necessary, various additives may be appropriately added to the end protection layer 18. Examples of additives include a conducting agent, a plasticizer, a leveling agent, a filler, a vulcanization accelerator, a processing aid, and a mold release agent.

The volume resistivity of the end protection layer 18 is not particularly limited because the end protection layer 18 does not form an image-forming area. The volume resistivity of the end protection layer 18 may be set from the semi-conductive area to the non-conductive area. Specifically, for example, it may be set in a range of $1.0\times10^{7}$ to $1.0\times10^{15}$ Ω·cm. The volume resistivity can be measured according to JIS K 6911. Since the end protection layer 18 does not form an image-forming area, the volume resistivity of the end protection layer 18 may be set higher than the volume resistivity of the surface layer 16 which is an image-forming area.

The thickness of the end protection layer 18 is not particularly limited, and may be set in a range of 0.1 to 5.0 μm. The thickness of the end protection layer 18 can be measured by observing the cross section using a laser microscope (for example, "VK-9510" commercially available from Keyence Corporation). For example, the thickness can be represented by an average of distances from the surface of the surface layer 16 to the surface of the end protection layer 18 measured at five arbitrary positions. Since the end protection layer 18 has a predetermined thickness, a step is formed between the surface of the end protection layer 18 and the surface of the surface layer 16. Since this step restricts movement of the toner in the image-forming area to the roll end, an effect of minimizing toner leakage can also be obtained accordingly.

The development roll 10 can be produced by forming the elastic layer 14 on the outer circumferential surface of the shaft 12, forming the surface layer 16 on the outer circumferential surface of the elastic layer 14, and forming the end protection layer 18 on the outer circumferential surface of the surface layer 16 at both ends in the axial direction.

The elastic layer 14 can be formed, for example, as follows. First, the shaft 12 is coaxially disposed in a hollow part of a roll molding mold, an uncrosslinked conductive rubber composition is injected, heated and cured (crosslinked), and demolding is then performed, or an uncrosslinked conductive rubber composition is extruded and molded on the surface of the shaft 12, and thus the elastic layer 14 is formed on the outer circumferential surface of the shaft 12.

The surface layer 16 can be formed by using a material forming the surface layer 16 (composition for a surface layer), applying it to the outer circumferential surface of the elastic layer 14, and appropriately performing a drying treatment or the like. The material forming the surface layer 16 may contain a diluting solvent. Examples of diluting solvents include ketone solvents such as methyl ethyl ketone (MEK) and methyl isobutyl ketone, alcohol solvents such as isopropyl alcohol (IPA), methanol, and ethanol, hydrocarbon solvents such as hexane and toluene, acetate solvents such as ethyl acetate and butyl acetate, ether solvents such as diethyl ether and tetrahydrofuran, and water.

The end protection layer 18 can be formed by using a material forming the end protection layer 18 (composition for an end protection layer), applying it to the outer circumferential surface of the surface layer 16 at both ends in the axial direction, and appropriately performing a drying treatment or the like. The material forming the end protection layer 18 may contain a diluting solvent. Examples of diluting solvents include ketone solvents such as methyl ethyl ketone (MEK) and methyl isobutyl ketone, alcohol solvents such as isopropyl alcohol (IPA), methanol, and ethanol, hydrocarbon solvents such as hexane and toluene, acetate solvents such as ethyl acetate and butyl acetate, ether solvents such as diethyl ether and tetrahydrofuran, and water.

According to the development roll 10 having the above configuration, since the end protection layer 18 contains a binder polymer and a surface modification agent having a cyano group, the amount of remaining charge at the roll end increases, and toner leakage from the roll end is minimized.

EXAMPLE

The disclosure will be described below in detail with reference to examples and comparative examples.

Preparation of Composition for Elastic Layer

A conductive silicone rubber (commercially available from Shin-Etsu Chemical Co., Ltd., "X-34-264A/B, mixing mass ratio A/B=1/1") was mixed using a static mixer to prepare a composition for an elastic layer.

Preparation of Elastic Layer

A solid cylindrical iron bar with a diameter of 6 mm was prepared as a shaft, and an adhesive was applied to the outer circumferential surface. The shaft was set in a hollow space of a roll forming mold, the prepared composition for an elastic layer was then injected in to the hollow space and heated and cured at 190° C. for 30 minutes, and demolding was performed. Thereby, a roll-like elastic layer (with a thickness of 3 mm) made of a conductive silicone rubber was formed along the outer circumferential surface of the shaft.

Preparation of Surface Layer 10 parts by mass of a thermoplastic polyurethane ("NIPPOLLAN 5199" commercially available from Tosoh Corporation), 60 parts by mass of a polyether diol (bifunctional polypropylene glycol) ("ADEKA polyether P-1000" commercially available from ADEKA Corporation), 30 parts by mass of a polyisocyanate (hexamethylene diisocyanate trimer) ("Coronate HX" commercially available from Tosoh Corporation), 3 parts by mass of an electron-conducting agent (carbon black) ("Ketjen EC300J" commercially available from Lion Corporation), and 0.5 parts by mass of an ion-conducting agent (tetramethylammonium chloride) (commercially available from Tokyo Chemical Industry Co., Ltd.) were dissolved in MEK so that the solid content concentration was 20 mass %, and the mixture was sufficiently mixed and dispersed using three rolls. The prepared composition for a surface layer was roll-coated on the outer circumferential surface of the elastic layer and heated, and thereby surface layer (with a thickness of 15 μm) was formed on the outer circumferential surface of the elastic layer.

Preparation of End Protection Layer

Respective components were blended according to formulations (parts by mass) described in tables, and the concentration was adjusted with a diluting solvent (MIBK) so that the solid content concentration was 25 mass %, and a composition for an end protection layer was prepared. Then, the composition for an end protection layer was roll-coated on the outer circumferential surface of the surface layer at both ends (non-image-forming area) in the axial direction and heated, and thereby an end protection layer (with a thickness of 1 μm) was formed on the outer circumferential surface of the surface layer at both ends in the axial direction. Accordingly, a development roll was prepared.

Materials used as materials of the end protection layer were as follows.

- Thermoplastic polyurethane: "NIPPOLLAN 5196" commercially available from Nippon Polyurethane Industry Co., Ltd.
- PPG-based polyol: "ADEKA polyether P1000" commercially available from ADEKA Corporation
- TDI-based isocyanate: "Coronate L" commercially available from Tosoh Corporation
- Surface modification agent <1>: Fluorine type (having a cyano group), "Aron GF400" commercially available from Toagosei Co., Ltd.
- Surface modification agent <2>: Silicone type (having a cyano group), Synthetic product A
- Surface modification agent <3>: Fluorine type (having no cyano group), "Megaface F553" commercially available from DIC
- Surface modification agent <4>: Fluorine type (having no cyano group), "Megaface F561" commercially available from DIC
- Surface modification agent <5>: Silicone type (having no cyano group), "SymacUS-270" commercially available from Toagosei Co., Ltd.
- Thermally conductive filler <1>: Aluminum oxide, "AL-160SG-3" commercially available from Showa Denko K.K.
- Thermally conductive filler <2>: Magnesium oxide, "Kyowamag MF30" commercially available from Kyowa Chemical Industry Co., Ltd.

Synthesis of Surface Modification Agent <2>

9.98 g (98.64 mmol) of methyl methacrylate (reagent), 1.66 g (0.36 mmol) of an acrylate-modified silicone oil ("X-22-174DX" commercially available from Shin-Etsu Chemical Co., Ltd.), 0.07 g (1 mmol) of methacrylonitrile (reagent), 1.24 g (4 mmol) of dimethyl 1,1'-azobis (1-cyclohexanecarboxylate) ("VE-73" commercially available from Wako Pure Chemical Industries, Ltd.) and 10.50 g of MEK were put into a 100 mL reaction flask, nitrogen bubbling was performed for 5 minutes with stirring, and polymerization was then performed at an internal liquid temperature of 80° C. for 7 hours. Then, 19.45 g of MEK was added to obtain a surface modification agent <2> (Synthetic product A) having a prepared solid content of 30%.

Toner leakage was evaluated using the prepared development roll. In addition, the amount of remaining charge was measured using the prepared development roll. In addition, the film resistance was measured using the prepared composition for an end protection layer. The formulation composition (parts by mass) of the composition for an end protection layer and the evaluation results are shown in the following table.

Toner Leakage

The prepared development roll was cured in an HH environment (32.5° C.×85% RH) for 4 hours and then incorporated into a commercially available color laser printer ("HL-L9319CDW" commercially available from Brother Industries, Ltd.), and 1,000 solid white images were continuously printed, and the roll end was then observed. If the toner did not leak from the roll end, next, 1,000 solid white images were continuously printed, and the roll end was observed. This was repeated until the toner leaked from the roll end, and the number of durable sheets until the toner leaked was examined.

Amount of Remaining Charge

A voltage (1,000 μA) was applied to the prepared development roll from a power source (amplifier), and the amount of remaining charge in the end protection layer 5 seconds after the application was stopped was measured with a surface potential meter.

Film Resistance

The composition for an end protection layer was bar-coated on a release PET and heated to form a film (with a thickness of 15 to 30 μm). The obtained film was peeled off from the release PET and used as an evaluation sheet sample. The volume resistivity (Ω·m) when an applied voltage of 500 V was applied to the evaluation sheet sample using an electrical resistivity meter (measurement range $10^4$ to $10^{18}$Ω) ("6517B type electrometer" commercially available from Keithley Instruments) according to JIS-K 6911, was measured.

TABLE 1

| | | Example | | | | | | |
|---|---|---|---|---|---|---|---|---|
| | | 1 | 2 | 3 | 4 | 5 | 6 | 7 |
| Formulation | Thermoplastic polyurethane | 10 | 10 | 10 | 10 | 10 | 10 | 10 |
| | PPG-based polyol | 60 | 60 | 60 | 60 | 60 | 60 | 60 |
| | TDI-based isocyanate | 30 | 30 | 30 | 30 | 30 | 30 | 30 |
| | Surface modification agent <1>: Fluorine type (having cyano group) | 0.1 | 1.0 | 5.0 | 20 | — | 20 | 20 |
| | Surface modification agent <2>: Silicone type (having cyano group) | — | — | — | — | 1.0 | — | — |
| | Surface modification agent <3>: Fluorine type (having no cyano group) | — | — | — | — | — | — | — |
| | Surface modification agent <4>: Fluorine type (having no cyano group) | — | — | — | — | — | — | — |
| | Surface modification agent <5>: Silicone type (having no cyano group) | — | — | — | — | — | — | — |
| | Thermally conductive filler <1>: Aluminum oxide | — | — | — | — | — | 60 | — |
| | Thermally conductive filler <2>: Magnesium oxide | — | — | — | — | — | — | 60 |
| Evaluation | Toner leakage (durable sheet) (×1,000) | 10 | 13 | 15 | 20 | 10 | 25 | 23 |
| | Amount of remaining charge (V) | 6.0 | 7.0 | 8.0 | 9.0 | 4.5 | 9.0 | 9.0 |
| | Film resistance (Ω · cm) | $2.89 \times 10^{10}$ | $4.13 \times 10^{10}$ | $5.21 \times 10^{10}$ | $7.65 \times 10^{10}$ | $2.74 \times 10^{10}$ | $3.54 \times 10^{9}$ | $4.64 \times 10^{9}$ |

TABLE 2

| | | Comparative Example | | | |
|---|---|---|---|---|---|
| | | 1 | 2 | 3 | 4 |
| Formulation | Thermoplastic polyurethane | 10 | 10 | 10 | 10 |
| | PPG-based polyol | 60 | 60 | 60 | 60 |
| | TDI-based isocyanate | 30 | 30 | 30 | 30 |
| | Surface modification agent <1>: Fluorine type (having cyano group) | — | — | — | — |
| | Surface modification agent <2>: Silicone type (having cyano group) | — | — | — | — |
| | Surface modification agent <3>: Fluorine type (having no cyano group) | — | 1.0 | — | — |
| | Surface modification agent <4>: Fluorine type (having no cyano group) | — | — | 1.0 | — |
| | Surface modification agent <5>: Silicone type (having no cyano group) | — | — | — | 1.0 |
| | Thermally conductive filler <1>: Aluminum oxide | — | — | — | — |
| | Thermally conductive filler <2>: Magnesium oxide | — | — | — | — |
| Evaluation | Toner leakage (durable sheet) (×1,000) | 0.1 | 1.0 | 1.0 | 4.0 |
| | Amount of remaining charge (V) | 2.0 | 3.0 | 3.0 | 3.0 |
| | Film resistance (Ω · cm) | $1.76 \times 10^{10}$ | $2.67 \times 10^{10}$ | $2.86 \times 10^{10}$ | $2.34 \times 10^{10}$ |

In Comparative Example 1, the end protection layer did not contain a surface modification agent. In Comparative Examples 2 to 4, the end protection layer contained a surface modification agent, but did not contain a surface modification agent having a cyano group. Therefore, in Comparative Examples 1 to 4, toner leakage from the roll end was likely to occur. On the other hand, in examples, the end protection layer contained a surface modification agent having a cyano group. Therefore, in examples, toner leakage from the roll end was unlikely to occur.

Here, comparing Examples 2 and 5, it can be understood that, when the surface modification agent having a cyano group was a fluorine-based surface modification agent, an effect of minimizing toner leakage from the roll end was improved. In addition, comparing Examples 4, 6, and 7, it can be understood that, when the end protection layer contained a thermally conductive material in addition to the surface modification agent having a cyano group, an effect of minimizing toner leakage from the roll end was improved.

While embodiments and examples of the disclosure have been described above, the disclosure is not limited to the embodiments and examples, and various modifications can be made without departing from the spirit and scope of the disclosure.

What is claimed is:

1. A development roll for electrophotographic apparatuses, comprising:

a shaft;

an elastic layer formed on an outer circumferential surface of the shaft;

a surface layer formed on an outer circumferential surface of the elastic layer; and an end protection layer formed on an outer circumferential surface of the surface layer at both ends in an axial direction, wherein the end protection layer contains a binder polymer and a surface modification agent having a cyano group, wherein the binder polymer is a polyurethane; and the surface modification agent having a cyano group is a fluorine-based surface modification agent and is contained in an amount in a range of 0.1 to 20 parts by mass with respect to 100 parts by mass of the binder polymer.

* * * * *